US007526897B2

(12) United States Patent
Collins

(10) Patent No.: US 7,526,897 B2
(45) Date of Patent: May 5, 2009

(54) J-CHANNEL BACKER MATERIAL

(75) Inventor: P. Michael Collins, Cincinnati, OH (US)

(73) Assignee: PACC Systems I.P., LLC, Cincinnati, OH (US)

( * ) Notice: Subject to any disclaimer, the term of this patent is extended or adjusted under 35 U.S.C. 154(b) by 779 days.

(21) Appl. No.: 10/989,790

(22) Filed: Nov. 16, 2004

(65) Prior Publication Data

US 2005/0183359 A1 Aug. 25, 2005

Related U.S. Application Data

(63) Continuation-in-part of application No. 10/602,198, filed on Jun. 24, 2003, now abandoned.

(60) Provisional application No. 60/391,333, filed on Jun. 25, 2002.

(51) Int. Cl.
*E06B 1/04* (2006.01)

(52) U.S. Cl. ..... 52/212; 52/211; 52/98; 52/217; 52/716.1; 52/716.4; 52/717.01; 52/717.03

(58) Field of Classification Search ..... 52/211, 52/212, 213, 210, 208, 98, 216, 217, 716.1, 52/716.4, 717.01, 717.03
See application file for complete search history.

(56) References Cited

U.S. PATENT DOCUMENTS

| | | | | |
|---|---|---|---|---|
| 2,305,413 | A | 12/1942 | Gelin | |
| 2,736,930 | A * | 3/1956 | Longley | 52/211 |
| 3,707,815 | A | 1/1973 | Molyneux | |
| 3,759,005 | A | 9/1973 | Smith | |
| 3,919,815 | A | 11/1975 | Alabaster | |
| 3,922,826 | A | 12/1975 | Molyneux | |
| 4,084,361 | A | 4/1978 | Aspaas | |
| 4,246,304 | A * | 1/1981 | Dixon | 428/34.1 |
| 4,265,052 | A | 5/1981 | Johnson et al. | |
| 4,302,916 | A | 12/1981 | Molyneux | |
| 4,967,519 | A | 11/1990 | Sieber | |
| 4,972,640 | A | 11/1990 | DeFazio | |
| 5,058,323 | A * | 10/1991 | Gerritsen | 49/504 |
| 5,119,605 | A | 6/1992 | Sieber | |
| 5,203,130 | A * | 4/1993 | Freelove | 52/211 |
| 5,519,969 | A * | 5/1996 | Golba | 52/60 |
| 5,758,458 | A * | 6/1998 | Ridge | 52/204.1 |
| 5,815,986 | A | 10/1998 | Laska | |
| 6,125,605 | A * | 10/2000 | Young | 52/717.01 |
| 6,205,724 | B1 | 3/2001 | Garling et al. | |
| 6,244,001 | B1 | 6/2001 | Anastasi | |
| 6,269,597 | B1 | 8/2001 | Haas | |
| 6,378,266 | B1 * | 4/2002 | Ellingson | 52/656.4 |
| 6,625,941 | B2 * | 9/2003 | Shaw | 52/211 |

* cited by examiner

*Primary Examiner*—Richard E Chilcot, Jr.
*Assistant Examiner*—Chi Q Nguyen
(74) *Attorney, Agent, or Firm*—Wood, Herron & Evans, L.L.P.

(57) ABSTRACT

A finishing member for masonry walls allows for simple installation and accurate placement of caulking around windows and doors in cavity wall construction. This invention accommodates a wide variety of window or door frame profiles, particularly those having an outwardly directed channel such as so called J-channel frames, for the detailing and finishing work required for proper installation of a window or door into a masonry veneer or cavity wall construction without requiring a highly skilled and labor intensive installation.

10 Claims, 3 Drawing Sheets

J-CHANNEL BACKER MATERIAL

This is a continuation in part of U.S. patent application Ser. No. 10/602,198 filed Jun. 24, 2003, now abandoned which in turn claims the benefit of U.S. Provisional Patent Application Ser. No. 60/391,333, filed Jun. 25, 2002, each of which is hereby incorporated by reference entirely.

BACKGROUND OF THE INVENTION

This invention relates to masonry veneer or cavity wall construction and, more particularly, to devices used in association with window and door installations in a veneer/cavity wall system for proper transition between the window or door installation and the masonry veneer.

Wall systems having a masonry exterior are typically constructed of at least one vertical layer of masonry and at least a second vertical layer of a material forming a back-up system. The back-up system may be constructed of lumber, light gauge steel studs or of a concrete masonry unit. The masonry and back-up system are typically bonded together by horizontal metallic ties spaced apart vertically. A space is often provided in such wall systems (e.g., cavity wall systems) between the masonry and back-up system for moisture drainage. Normally, a 1 to 2 inch air space between the masonry and back-up system is adequate to provide drainage. Insulation may also be placed in the space to improve the energy efficiency of masonry buildings.

Masonry veneer, and cavity wall construction in general, has many advantages and is commonly utilized in residential and commercial construction. Problems often arise during construction, however, in maintaining a proper transition between the wall structure and window, door and other openings or discontinuities in the wall. For example, the dimensioning of the window or door frame installed in the wall is frequently different and incompatible with the thickness, geometry and dimensions of the masonry veneer or cavity wall construction. Caulk is often used along the wall jamb and header in an effort to provide a water tight seal and aesthetic transition to the window or door frame.

One example of a window or door frame is called a J-channel frame which has an outwardly directed open channel along the jamb portions of the frame. The J-channel frame is specifically designed for use on siding clad exterior walls and not masonry exterior walls. The often rough cut ends of the siding are inserted into and concealed within the channel of the frame to present a neat and finished appearance at the transition from the wall to the frame. Nevertheless, the J-channel frame is often used with masonry walls for a variety of reasons. In such cases, the channel is vacant and must be flashed for a proper installation and must receive a backer material for the effective placement of caulking and sealant.

However, due to the incompatibility of the J-channel frame with the masonry veneer, effective and aesthetic caulk application is nearly impossible. As a result, the detailing and finishing work required for proper installation of a window or door into a masonry veneer or cavity wall construction is typically very labor intensive, non-uniform and highly dependent upon the skill and experience of the particular contractor or tradesman performing the installation particularly when a J-channel is used. Because of the importance and wide spread popularity of such masonry structures, a better method for proper and consistent installation of windows and doors in such construction is needed.

SUMMARY OF THE INVENTION

This invention provides a solution to these and other problems in the art and allows an efficient and reliable installation for a water tight and an aesthetically pleasing transition from surrounding the window or door to the masonry veneer. Generally, in one embodiment this invention includes a backer unit or finishing member installed adjacent the J-channel window frame or door frame to provide a proper transition from the frame to the masonry wall structure. In one embodiment, the finishing member has a generally L-shaped configuration with a first leg of the member being mounted in the cavity defined by the channel of the J-channel frame. The second leg of the finishing member projects generally perpendicularly from the first leg and between the forward edge of the window or door J-channel frame and the masonry outer wall. In one embodiment, the first leg is frangibly joined to the second leg by a perforated joint for selective separation of the second leg from the first leg.

After the finishing member is installed adjacent to the frame and the inner and outer wall construction is complete, the terminal end portion of the second leg is removed by being torn along the frangible joint. After the terminal end portion is removed, a recess is exposed at a juncture with the frame and the remainder of the finishing member. A bead of caulk or similar finishing material is applied in the recess to provide a smooth and aesthetically pleasing transition from the J-channel frame to the masonry wall. Additionally, the juncture between the frame and the wall is sealed by the caulk bead to inhibit and/or prevent the entry of moisture or other foreign material and the void in the J-channel is substantially filled.

Advantageously, the finishing member is readily adaptable for use with a wide variety of window and door J-channel or other frame designs and construction specifications without requiring highly skilled or specialized installation and construction techniques.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
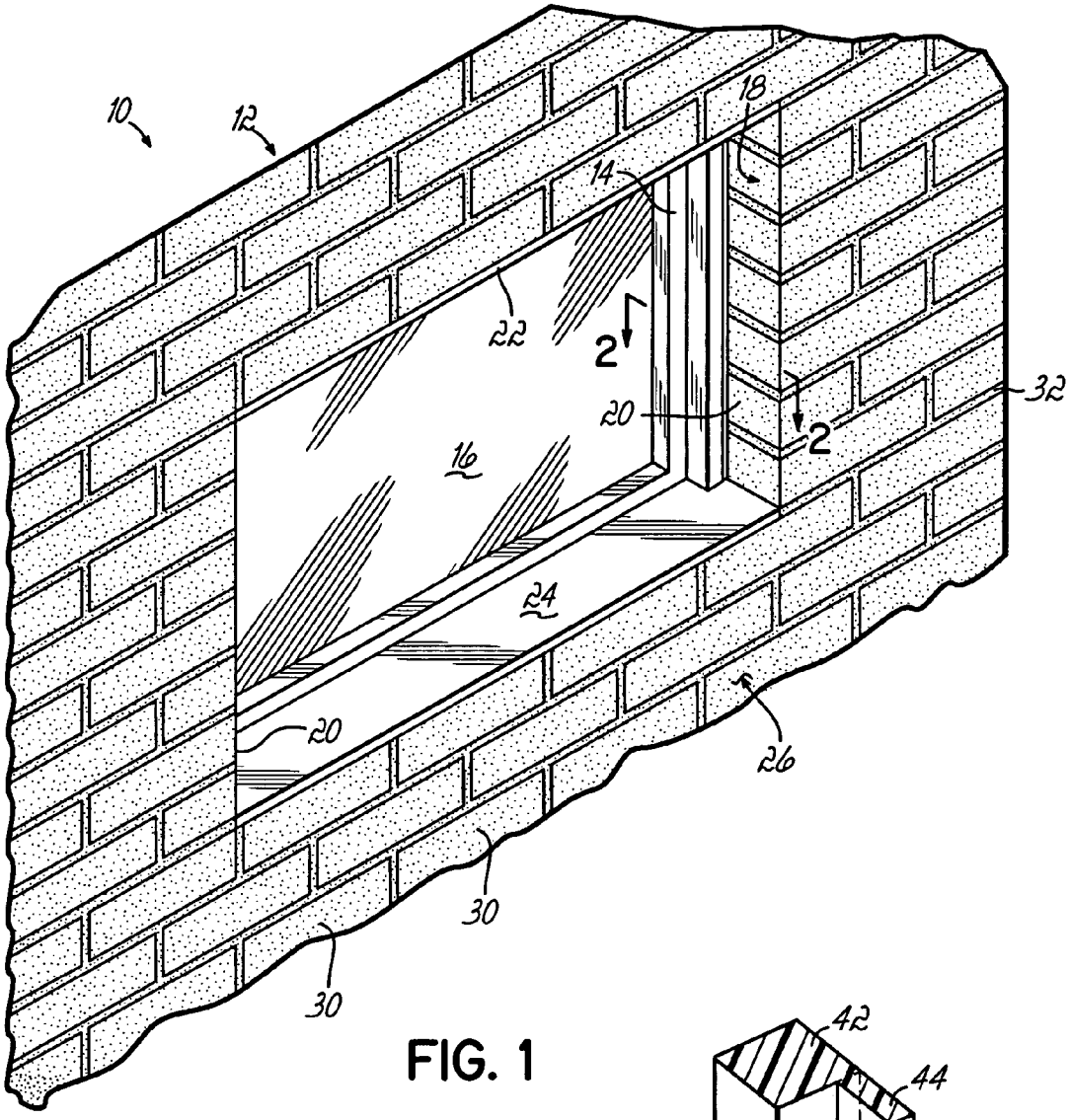
FIG. 1 is an exemplary view of a window installation in a masonry wall.

Referring to FIG. 1, an exemplary window installation 10 in a masonry wall 12 is shown. The window installation 10 includes a perimeter window frame 14, one or more window panes 16, and a window opening 18 in the wall defined by a pair of jambs 20 and a header 22 above and a sill 24 below the window frame 14. Although one example of a window installation is shown in FIG. 1, this invention is readily applicable for a variety of closure elements in openings in the wall such as other types of window installations, frame designs, doors and the like.

Figure 2:
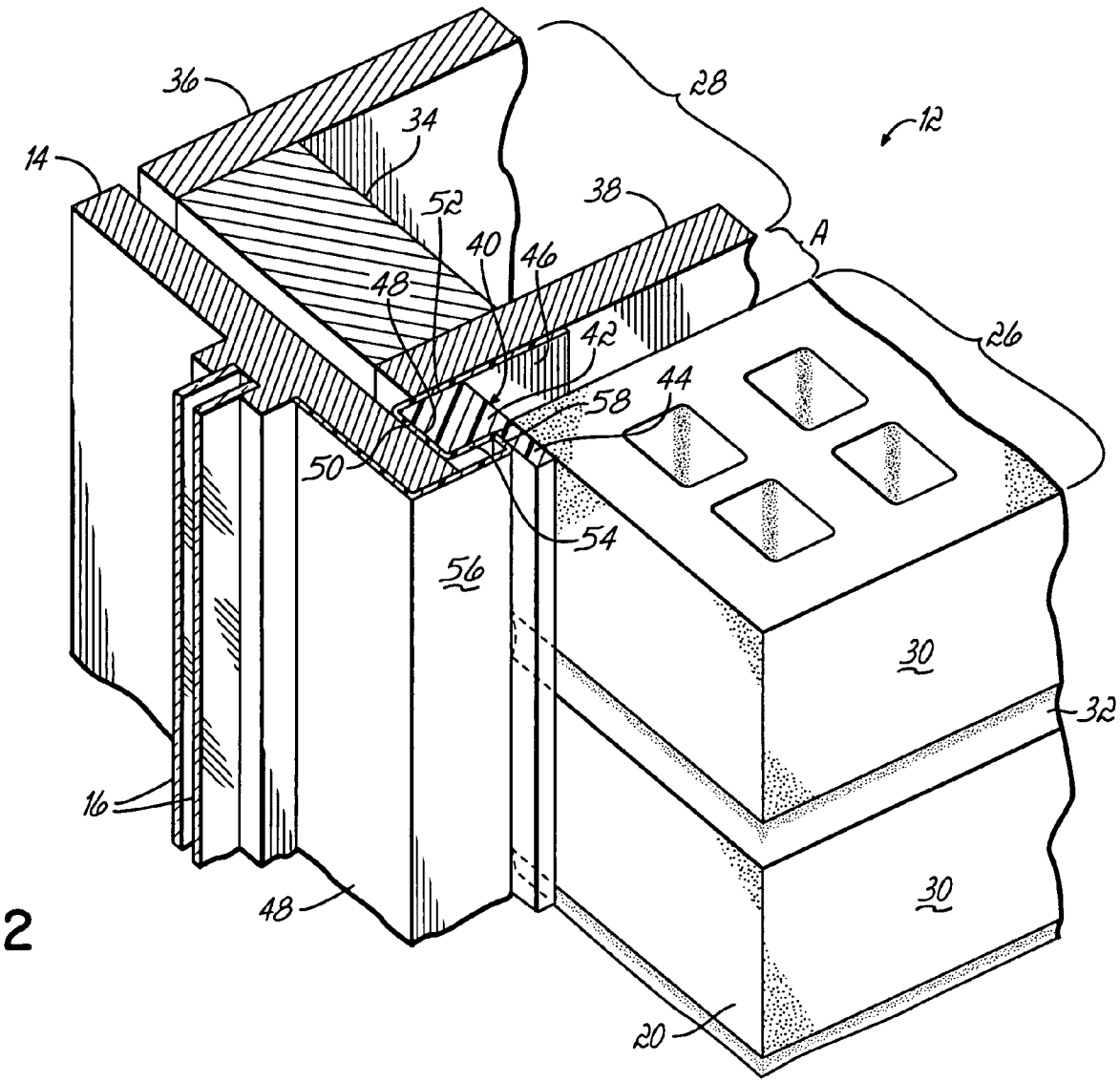
FIG. 2 is a perspective cross sectional view taken along line 2-2 in FIG. 1 of a transition between the wall jamb and a J-channel window frame according to one embodiment of this invention.
Figure 3:
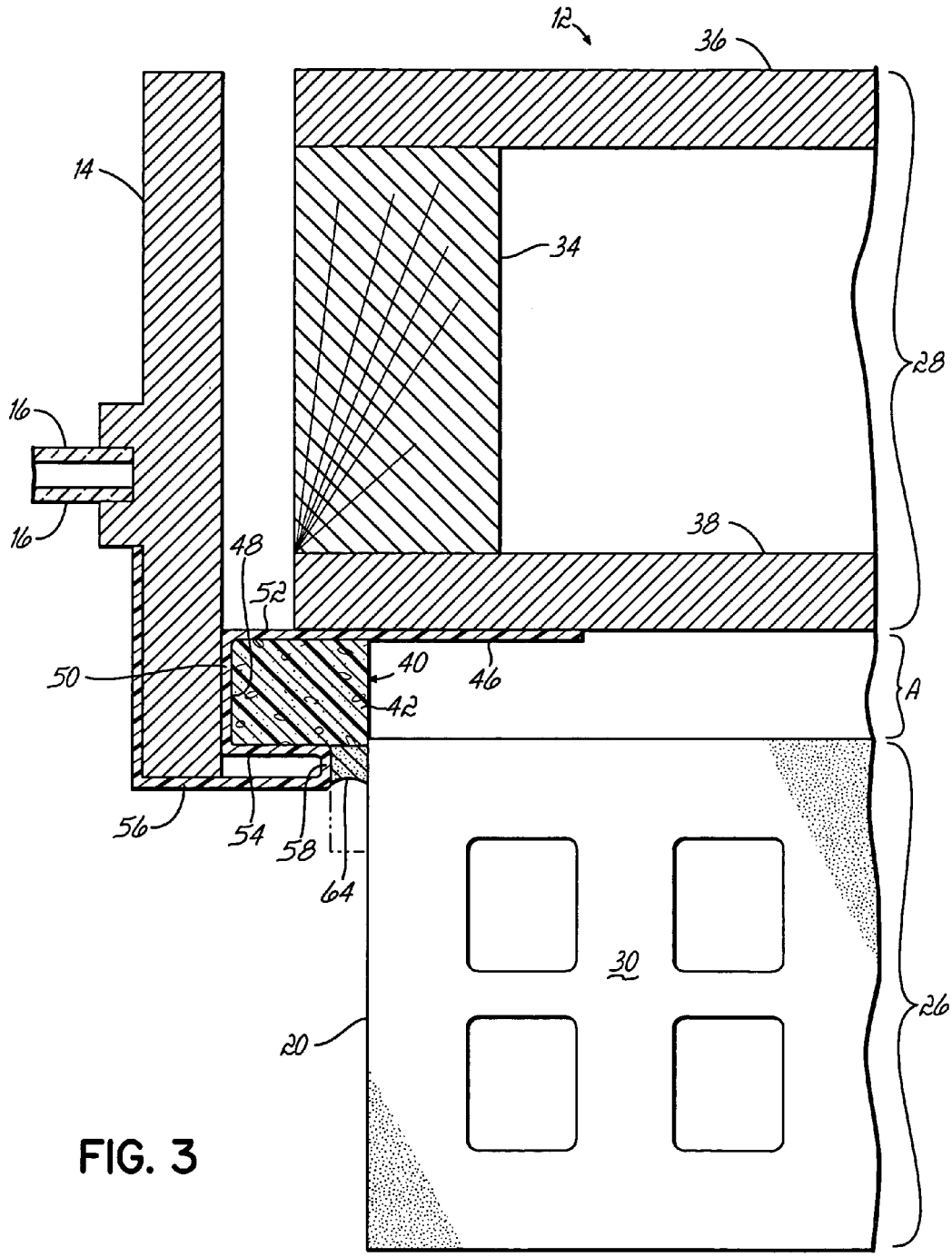
FIG. 3 is a cross sectional plan view taken along line 2-2 of FIG. 1 showing the transition between the wall jamb and window frame shown in FIG. 2.

As shown more clearly in FIGS. 2-3, the masonry wall 12 for the exterior of a building, in one embodiment, is comprised of an outer wall of masonry or brick veneer 26 and an insulated interior wall 28. The brick veneer outer wall 26 is constructed from a plurality of bricks or blocks 30 arranged in a vertical pattern. Each brick 30 is of a substantially rectangular shape having a uniform length, height and depth. The brick veneer 26 is built up by placing one layer of bricks 30 over another layer, with the upper layer vertically offset from the lower layer by a distance of approximately one-half the length of a brick 30. Thus, as shown in FIG. 1, a brick 30 on one layer is positioned directly over the space between two bricks 30 on the layer immediately beneath it. The spaces between adjacent bricks 30 and between adjacent layers of bricks are filled with mortar 32. Alternatively, the veneer 26 may be stone or other masonry components.

The interior wall 28 includes wood framing studs 34, dry wall 36, and outer sheathing material 38. Other materials may be used as is well known in the art. For example, a liner board (not shown) as disclosed in U.S. patent application Ser. No. 10/417,761 filed Apr. 17, 2003 and hereby incorporated by reference, may be used on the outer sheathing material 38. In any event, the building wall 12 is constructed so that there is a small cavity or airspace A between the back side of the brick veneer 26 and the outer surface of the interior wall 28. The airspace A between the back side of the brick veneer 26 and the surface of the interior wall 28 is usually at least about one to two inches deep, although the exact dimension may vary depending upon the nature of the construction.

Figure 4:
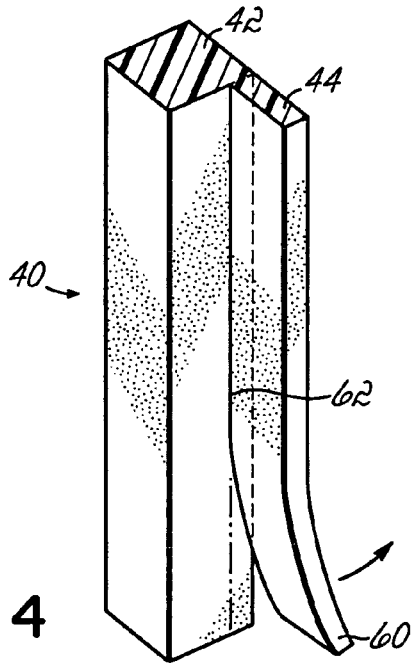
FIG. 4 is a perspective view of a finishing member according to one embodiment of this invention adapted to be used in the frame of FIGS. 1-3.

Referring to FIGS. 2-4, a first embodiment of a finishing member 40 is shown installed in the installation 10 to provide a proper transition from the window frame 14 to the wall 12. The member 40 is installed along the jambs 20 of the window opening 18 in cooperation with the corresponding portions of the window frame 14. As shown in FIGS. 2 and 3, a nailing flange 46 is typically provided from the portion of the window frame 14 adjacent the jamb 20 and extending to the outer surface of the inner wall 28. Nails or other mechanical fasteners (not shown) are inserted through the nailing flange 46 into the sheathing material 38, thereby securing the window frame 14 in position.

The cross-sectional configuration of the J-channel frame 14 includes an outwardly directed open channel 48 joined to the proximal end of the nailing flange 46 along the jamb portion. As previously stated, the J-channel frame 14 and the outwardly open channel 48 are typically intended for use with siding clad walls in which the rough cut edges of the siding are inserted into the open channel 48 and concealed therein for a finished and aesthetically pleasing appearance to the installation. Nevertheless, commonly the J-channel frame design is utilized with masonry walls 12 and previously the channel 48 was improperly flashed or sealed or not filled at all.

The channel 48 is generally U-shaped in which a bight portion 50 of the channel 48 separates a pair of channel side walls 52, 54. A forwardmost surface 56 of the J-channel frame 14 is separated from the adjacent channel side wall 54 by a connecting leg 58 of the frame 14 as shown in FIGS. 2-3.

In one embodiment, the finishing member 40 is generally L-shaped, in which a first leg 42 of the member 40 is inserted into the channel 48 of the frame 14, and a second leg 44 of the member 40 projects generally perpendicular to the plane of the wall 12 and is juxtaposed to the outer wall or veneer 26 at the window opening 18 to provide a transition from the window frame 14 to the wall 12. Commonly, a standard backer rod is used to fill a gap between a frame and the wall 12 and provide a surface on which caulk or other sealant can be applied to provide a sealed transition between the standard frame and the wall 12. However, the gap and spacing between the J-channel frame 14 and the wall 12 is significantly larger, deeper (on the order of ⅛ to ¼ inch or greater) and of a geometry that is not compatible for standard backer rod materials. The standard backer rod materials would not be secure in the gap nor provide a stable backing for the application of the caulk or sealant. Therefore, a proper transition from the window frame 14 to the wall 12 that is effectively sealed against wind, rain, and other elements as well as aesthetically pleasing is often difficult if not impossible. The wide variety, sizes and configurations of window frames 14 available from various manufacturers increases the complexity and difficulty with providing a proper transition from the window frame 14 to the wall 12. Nevertheless, the finishing member 40 of this invention provides a solution.

The finishing member 40 also allows for expansion and contraction of the window frame 14 relative to the wall 12 during a variety of climatic conditions. In one embodiment, the member 40 is made of closed cell foam and bends, contracts, expands or deflects to accommodate of the wall 12 relative to the frame 14. In combination with the beads of caulk as appropriate, the finishing member 40 of this invention serves as a backer material and provides for a durable, reliable, easily installed and sealed transition from the window frame 14 to the wall 12. In certain other embodiments, the member 40 is extruded from a variety of thermoplastic or other polymeric materials. Alternatively, the member 40 may be aluminum or other materials resistant to rust and weather.

In one embodiment of the invention, the leg 42 of the member 40 is approximately ⅞" in length and ⅝" thick; whereas the leg 44 is approximately ⅝" in length and ¼" thick, although other dimensions of the member 40 are possible within this invention as compatible with the frame 14 configurations and sizes.

Referring to FIG. 4, a perspective view of the finishing member 40, according to this invention, is shown. In this embodiment, the member 40 is generally L-shaped in which the first leg 42 is adapted to mount to the frame 14 and be inserted in the channel 48, and the second leg 44 of the member 40 projects generally perpendicular to provide a transition from the frame 14 to the wall 12. The second leg 44 is constructed of closed cell foam and includes a terminal end portion 60 joined to a remainder of the member 40 by a frangible connection 62 such as a series of perforations to provide for the convenient and easy removal of the terminal end portion 60. The second leg 44 may include multiple spaced connections 62 for use with a variety of configurations.

During installation of the finishing member 40 and in construction of the cavity wall 12, the inner wall 28 is constructed with an opening 18 for the window, door or other installation. The frame 14, is inserted into the opening 18 and the member 40 is mounted to the channel of the frame 14 as previously described. The outer veneer wall 26 is constructed with courses of masonry units 30 and mortar 32. After construction of the outer veneer wall 26 is completed, the terminal end portion 60 of the second leg 44 may be removed along the frangible connection 62 thereby exposing a recess at the juncture between the frame 14, the remainder of the member 40 and the wall 12. As shown in FIG. 3, the recess may be filled with a bead of caulk 64 to provide an aesthetically pleasing transition from the frame 14 to the wall 12, as well as sealing the juncture between the frame 14 and the wall 12.

From the above disclosure of the general principles of the present invention and the preceding detailed description of at least one preferred embodiment, those skilled in the art will readily comprehend the various modifications to which this invention is susceptible. Therefore, I desire to be limited only by the scope of the following claims and equivalents thereof.

I claim:

1. A cavity wall construction comprising:

a first wall;

a second wall generally parallel to and spaced from the first wall;

wherein the second wall is comprised of courses of masonry units held together with mortar;

an opening in the first and second walls, the opening including spaced jambs on opposite sides of the opening;

a frame sized and configured to fit within the opening, the frame having an outwardly directed channel; and at least one finishing member positioned at a juncture between the frame and one of the jambs of the opening, a first leg of the finishing member being interposed in the outwardly directed channel of the frame and a second leg of the finishing member being juxtaposed to the second wall to thereby provide a transition from the frame to the second wall;

the finishing member further comprising a terminal end portion and a frangible connection joining the terminal end portion to a remainder of the finishing member;

wherein the terminal end portion is adapted to be removed along the frangible connection and thereby reveal a recess at a juncture adjacent to the frame, the remainder of the finishing member and one of the jambs of the opening.

2. The cavity wall construction of claim 1 further comprising:

a bead of caulk positioned in the recess and sealing the juncture between the frame and the second wall.

3. The cavity wall construction of claim 1 wherein the first and second legs are generally perpendicular to each other.

4. The cavity wall construction of claim 1 wherein the opening is one of a window opening and a door opening and the frame is a J-channel frame for one of a window and a door.

5. The cavity wall construction of claim 1 wherein the finishing member is a closed cell foam material and the frangible connection comprises perforations in the closed cell foam material.

6. A cavity wall construction comprising:

a first wall;

a second wall generally parallel to and spaced from the first wall;

wherein the second wall is comprised of courses of masonry units held together with mortar;

an opening in the first and second walls, the opening including spaced jambs on opposite sides of the opening;

a frame sized and configured to fit within the opening, the frame having an outwardly directed channel;

wherein the opening is one of a window opening and a door opening and the frame is a J-channel frame for one of a window and a door;

at least one finishing member positioned at a juncture between the frame and one of the jambs of the opening, a first leg of the finishing member being interposed in the outwardly directed channel of the frame and a second leg of the finishing member being juxtaposed to the second wall to thereby provide a transition from the frame to the second wall a terminal end portion of the second leg;

a frangible connection joining the terminal end portion to a remainder of the finishing member;

wherein the terminal end portion is adapted to be removed along the frangible connection and thereby reveal a recess adjacent to the frame, the remainder of the finishing member and one of the jambs of the opening; and a bead of caulk positioned in the recess and sealing the juncture between the frame and the second wall.

7. A frame assembly adapted to be installed into an opening in a wall, the frame assembly comprising:

a frame sized and configured to fit within the opening, the frame having an outwardly directed channel along at least one side thereof; and at least one finishing member adapted to be positioned at a juncture between the frame and one of the jambs of the opening, the finishing member having a first leg interposed in the outwardly directed channel of the frame and a second leg of the finishing member adapted to be juxtaposed to the wall to thereby provide a transition from the frame to the wall;

the finishing member further comprising a terminal end portion and a frangible connection joining the terminal end portion to a remainder of the finishing member;

wherein the terminal end portion is adapted to be removed along the frangible connection and thereby reveal a recess at a juncture adjacent to the frame, the remainder of the finishing member and one of the jambs of the opening.

8. The frame assembly of claim 7 wherein the first and second legs are generally perpendicular to each other.

9. The frame assembly claim 7 wherein the frame is a J-channel frame, the frame assembly further comprising:

one of a window and a door mounted in the frame.

10. The frame assembly of claim 7 wherein the finishing member is a closed cell foam material and the frangible connection comprises perforations in the closed cell foam material.

* * * * *